US005341697A

United States Patent [19]

Isozumi

[11] Patent Number: 5,341,697

[45] Date of Patent: Aug. 30, 1994

[54] SHIFT LEVER SUPPORTING DEVICE FOR STARTER MOTOR

[75] Inventor: Shuzo Isozumi, Himeji, Japan

[73] Assignee: Mitsubishi Denki Kabushiki Kaisha, Tokyo, Japan

[21] Appl. No.: 27,468

[22] Filed: Mar. 8, 1993

[30] Foreign Application Priority Data

Mar. 30, 1992 [JP] Japan ..... 4-105510

[51] Int. Cl.[5] ..... F02N 15/06

[52] U.S. Cl. ..... 74/7 A; 74/7 E; 335/131

[58] Field of Search ..... 74/7 R, 7 A, 7 C, 7 E; 192/99 S; 335/131

[56] References Cited

U.S. PATENT DOCUMENTS

| | | | |
|---|---|---|---|
| 4,579,010 | 4/1986 | Colvin et al. | 74/7 A |
| 4,938,084 | 7/1990 | Morishita et al. | 74/6 |
| 4,995,275 | 2/1991 | Okamoto et al. | 74/7 A |
| 5,005,435 | 4/1991 | Sugiyama | 74/7 A |
| 5,016,484 | 5/1991 | Morikane | 74/6 |
| 5,142,923 | 9/1992 | McKnight et al. | 74/7 A X |

FOREIGN PATENT DOCUMENTS

| | | | |
|---|---|---|---|
| 1944721 | 3/1970 | Fed. Rep. of Germany | 74/7 A |
| 2548358 | 5/1977 | Fed. Rep. of Germany | 74/7 A |

*Primary Examiner*—Allan D. Herrmann
*Assistant Examiner*—David W. Laub
*Attorney, Agent, or Firm*—Sughrue, Mion, Zinn, Macpeak and Seas

[57] ABSTRACT

A shift lever supporting device for a starter motor has a support 40 in a cylindrical form which has at its front end a cut groove 40*a*, a shift lever 34 fitted to the groove at an intermediate portion of the shift lever, a connection pin 36 inserted in the support 40 and the intermediate portion of the shift lever to pivotally support the shift lever, and a packing 37 of rubber fitted to the rear end of the support 40 by interposing a plate 38. The support 40, the plate 38 and the packing 37 are inserted into a hole 6*a* formed in a front bracket 6, and the rear end of the packing is received by the front end of an intermediate bracket 4 or a yoke.

1 Claim, 4 Drawing Sheets

FIGURE 6 (A) PRIOR ART
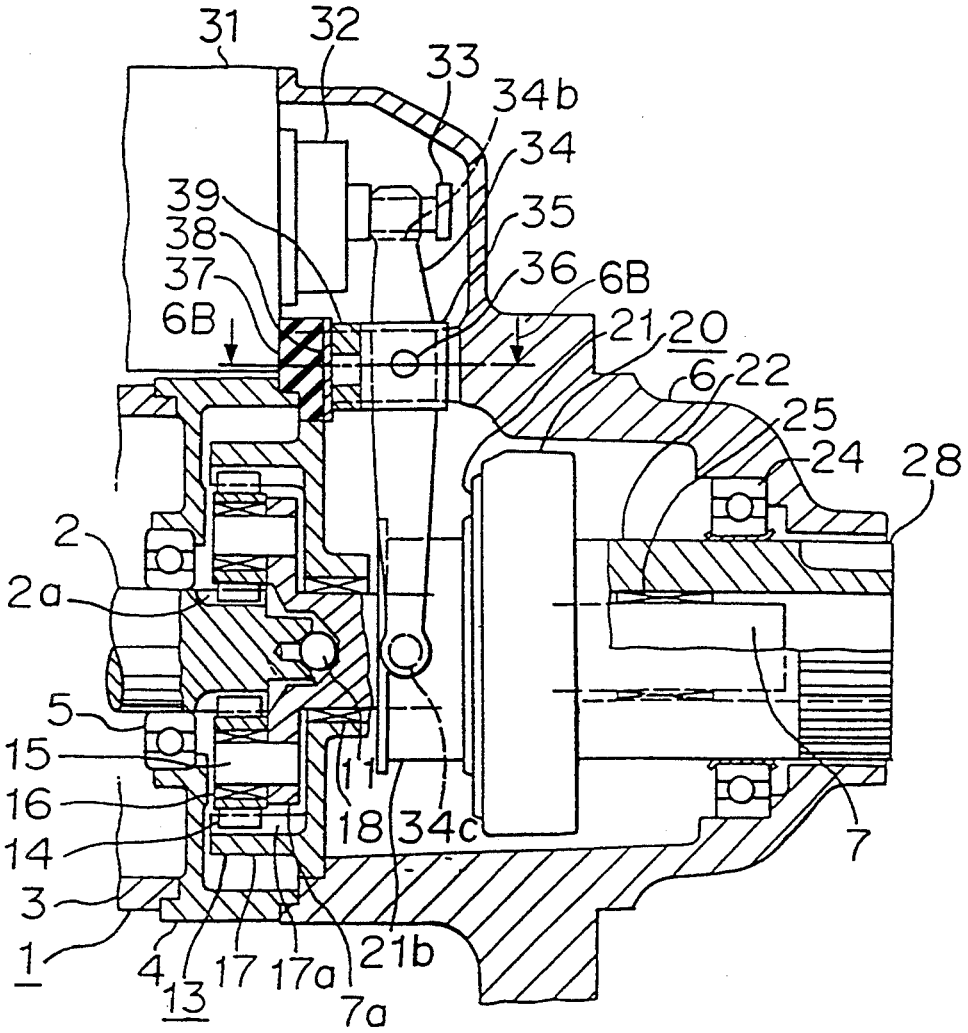
FIGURE 6 (B) PRIOR ART
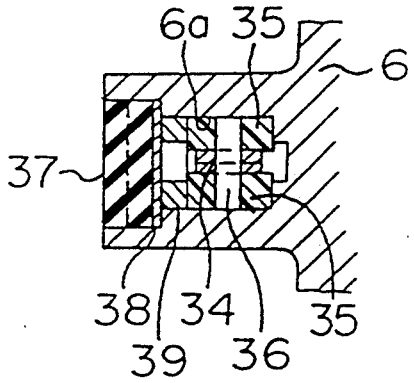

SHIFT LEVER SUPPORTING DEVICE FOR STARTER MOTOR

BACKGROUND OF THE INVENTION

1. Field of the Invention

The present invention relates to a shift lever supporting device for a starter motor in which a shift lever for advancing or retracting an overrunning clutch is pivotally supported by a front bracket.

2. Discussion of Background

FIG. 6A is a longitudinal cross-sectional view of a conventional starter motor having a shift lever supporting device, and FIG. 6B is a cross-sectional view taken along a line 6B—6B in FIG. 6A.

In FIGS. 6A and 6B, an armature shaft 2 extends from the armature of a d.c. motor 1. A small sun gear wheel 2*a* is formed at the front end portion of the armature shaft 2. A yoke 3 on which magnetic field poles (not shown) are mounted is connected to an intermediate bracket 4 which in turn supports the front end side (the left side in the drawing) of the armature shaft 2 by interposing a bearing 5. Reference numeral 6 designates a front bracket connected to the yoke 3 by interposing the intermediate bracket 4 and numeral 7 designates an output shaft arranged coaxially with the armature shaft 2 at its front end by interposing a steel ball 11.

A planet gear type speed reduction device 13 has a plurality of planet gear wheels 14 which are interlocked with the sun gear wheel 2*a*, and which are respectively supported by supporting pins 15 by interposing respective bearings 16. The supporting pins 15 are firmly attached to a carrier 7*a* which is a flange portion formed at the rear end of the output shaft 7. An inner gear wheel 17 is fixed to the front bracket 6 and has an inner tooth portion 17*a* to cause a revolution movement of the planet gear wheels 14 interlocked therewith. The rear end portion of the output shaft 7 is supported by the inner circumference of the front end portion of the inner gear wheel 17 by interposing a bearing 18.

An overrunning clutch 20 mounted on the output shaft 7 comprises a clutch outer 21 connected to the output shaft 7 by means of a helical spline and a clutch inner 22, for transmitting a one-way rotational force to the clutch outer 21 by means of rollers (not shown). The clutch inner 22 is supported by the front bracket 6 by means of a bearing 24, and it supports the output shaft 7 by interposing a bearing 25. An annular groove 21*b* is formed at an outer circumferential portion of the rear end side of the clutch outer 21. Numeral 28 designates a pinion formed at the front end portion of the clutch inner 22.

An electromagnetic switch 31 is attached to the front bracket 6. The front end portion of a hook 33 inserted in and supported by a plunger 32 which forms a movable iron core is extended from the electromagnetic switch 31. A shift lever 34 is arranged substantially vertically and has an upper end in a fork-like form to constitute an engaging portion 34*b* which is engaged with the hook 33, and the lower end in a fork-like form to thereby provide opposing engaging projections 34*c* which are engaged with the annular groove 21*b* of the overrunning clutch 20 so as to clamp the annular groove in the diametric direction.

As shown in FIG. 7, a pair of substantially cylindrical column-like support members 35 are attached to an intermediate portion of the shift lever 34 from its opposite sides, and a connecting pin 36 is inserted in that portion.

Numeral 37 designates a packing made of rubber which is disposed at the front end portion of the intermediate bracket 4, and a circular disk-like plate 38 made of a metallic material is disposed at the front side (right side in the drawing) of the packing 37. A spacer 39 made of a metallic material or nylon is interposed between the plate 38 and the support members 35. The packing 37, the plate 38 and the spacer 39 are inserted and held in a cylindrical hole 6*a* formed in the front bracket 6 as shown in FIG. 6B. The cylindrical hole 6*a* is formed at the rear end portion of the front bracket 6 and has upper and lower, diametrically opposed notches (in the longitudinal direction of the drawing). Thus, the shift lever 34 is pivotally supported around the connection pin 36 as a pivotal axis.

FIG. 7 shows the details of the shift lever 34. The shift lever 34 comprises a pair of pieces 34*a* which are formed by stamping a copper plate, and they are bonded by welding at their intermediate portions.

The support members 35 are disposed at opposite sides of the intermediate portion of the shift lever 34, and the connection pin 36 is inserted through holes formed in the support members and the shift lever 34.

The operation of the conventional shift lever supporting device will be described.

When a starter switch is turned on, an exciting coil (not shown) of the electromagnetic switch 31 is excited, and the plunger 32 is attracted inwardly (left side of the drawing), whereby the shift lever 34 is turned in a counter-clockwise direction by means of the hook 33 so that the overrunning clutch 20 is moved forwardly (right side in the drawing). Thus, the pinion 28 is interlocked with a ring gear of the engine. The retracting movement of the plunger 32 causes mutual contact between a movable contact and a fixed contact (both are not shown) to close a current circuit to the d.c. motor 1. Then, the armature is rotated to rotate the ring gear of the engine by means of the planet gear type speed reducing device 13, the overrunning clutch 20 and the pinion 28. The revolution of the ring gear starts the engine.

When the starter switch is turned off, a current to the exciting coil of the electromagnetic switch is turned off. Then, the plunger 32 is moved forwardly to open the current circuit to the d.c. motor 1. Simultaneously, the shift lever 34 is moved clockwise to thereby retract the overrunning clutch 20.

The conventional shift lever supporting device for a starter motor had such disadvantages that there were a number of elements for supporting the shift lever 34, and if they are assembled in a state that the support members disposed on both sides of the shift lever 34 are deviated from each other, much force is needed to cause the turning movement of the shift lever 34 due to a pushing force by the packing 37 disposed at the rear side of the shift lever.

SUMMARY OF THE INVENTION

It is an object of the present invention to provide a shift lever supporting device for a starter motor which is capable of reducing the number of structural elements for supporting a shift lever, and providing easy turning movement of it by reducing a force needed to turn the shift lever 34.

The foregoing and other objects of the present invention have been attained by providing a shift lever supporting device for a starter motor which comprises:

a shift lever having an end which is engaged with a hook in a electromagnetic switch so as to be movable in the axial direction, the other end which has a fork-like form to fit from both sides to an annular groove formed in an overrunning clutch so as to be movable in the axial direction, and an intermediate portion pivotally supported so that the overrunning clutch is moved forwardly and backwardly by the turning movement of the shift lever around a pivotal point;

a support in a cylindrical shape which has at an axially end portion a cut groove formed to pass through the diameter, into which the intermediate portion of the shift lever is inserted;

a connection pin which is inserted in each through hole formed in the support and the intermediate portion of shift lever so as to pivotally support the shift lever; and a packing of a resilient material whose end is in contact with an end of the support by interposing a plate-like material, wherein the support, the plate-like material and the packing are fitted in a cylindrical opening having a notch into which the shift lever is inserted, the cylindrical opening being formed, in a motor bracket, in the axial direction toward the other motor bracket.

BRIEF DESCRIPTION OF DRAWINGS

A more complete appreciation of the invention and many of the attendant advantages thereof will be readily obtained as the same becomes better understood by reference to the following detailed description when considered in connection with the accompanying drawings, wherein:

FIG. 6A is a longitudinal cross-sectional view partly broken of a conventional shift lever supporting device for a starter motor;

FIG. 6B is a cross-sectional view taken along a line 6B—6B in FIG. 6A.

DETAILED DESCRIPTION OF PREFERRED EMBODIMENTS

Figure 1:
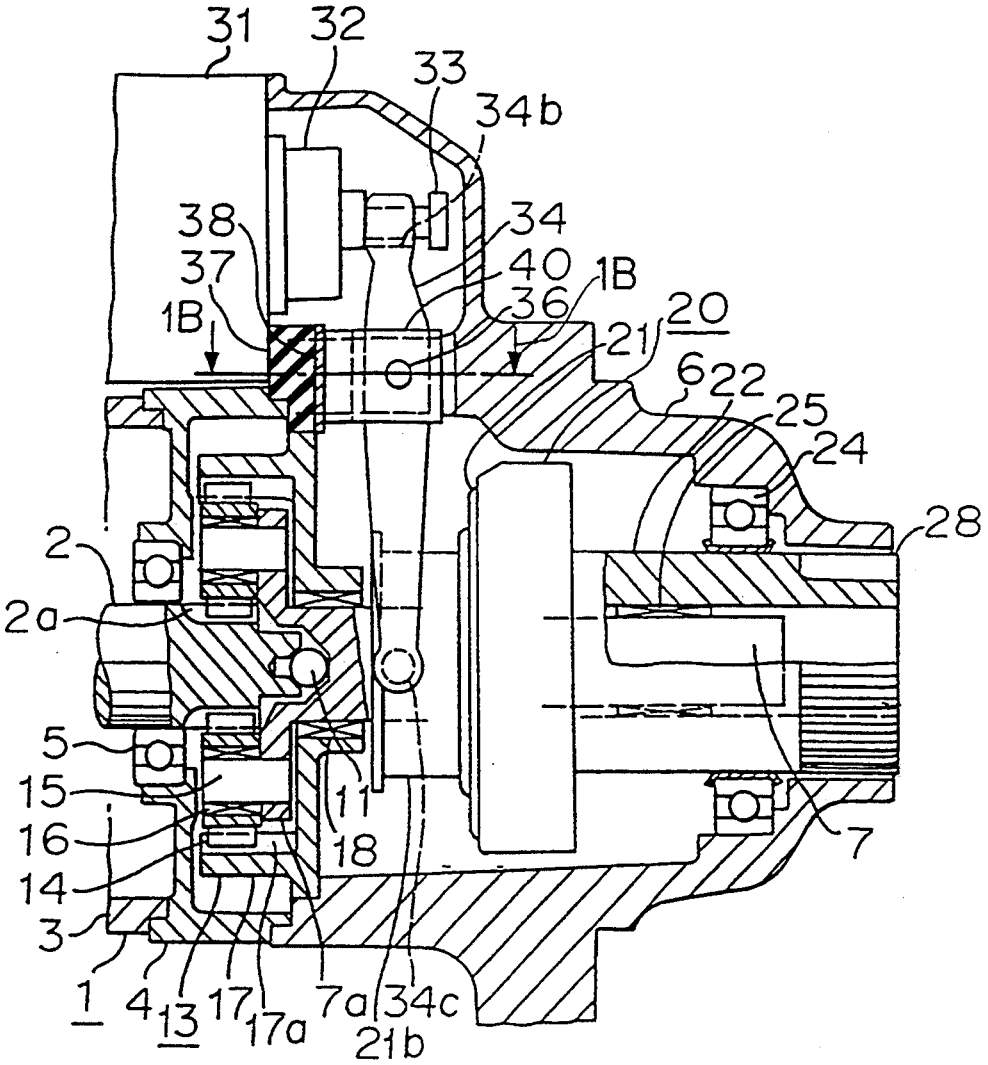
FIG. 1A is a longitudinal cross-sectional view of an embodiment of the shift lever supporting device for a starter motor according to the present invention.
FIG. 1B is a cross-sectional view taken along a line 1B—1B in FIG. 1.
Figure 1:
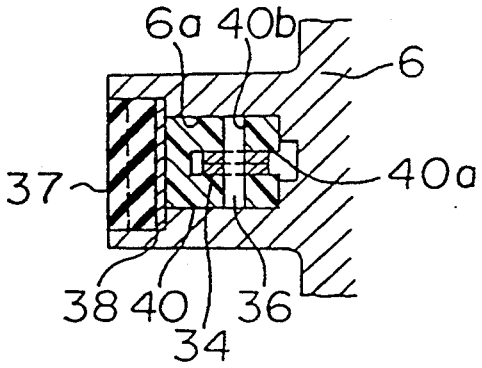

Referring to the drawings, preferred embodiments of the present invention will be described.

EXAMPLE 1

FIGS. 1A and 1B are respectively a longitudinal cross-sectional view, partly broken away, of an embodiment of the shift lever supporting device for a starter motor of the present invention and a sectional view taken along a line 1B—1B in FIG. 1A wherein numerals 1–7, 11, 13–18, 20–22, 24, 25, 28, 31–34, 36–38, **2*a*, 6*a*, 17*a*, 21*b*, 34*b* and 34*c* designate the same parts as those in FIG. 6**, and accordingly a description of these parts is omitted.

The shift lever supporting device of the first embodiment has a substantially cylindrical column-like support 40 made of a synthetic resinous material such as nylon (tradename) with a front end portion at which a cut groove **40*a* having openings in the longitudinal direction (i.e. in the longitudinal direction of the drawing) is formed. The shift lever 34 is inserted in the cut groove 40*a* so that both sides of the intermediate portion of the shift lever 34 oppose both inner surfaces of the cut groove 40*a*. The connection pin 36 is inserted in a pin hole 40*b* formed in the support 40 and the shift lever 34** whereby the shift lever is pivotally supported.

A packing 37 is disposed at the rear end of the support 40 by interposing a plate 38, and these three elements are inserted and held in a cylindrical retaining hole **6*a* formed in the bracket 6 so that the rear end of the packing 37 is in contact with the front end of the intermediate bracket 4**.

Figure 2A:
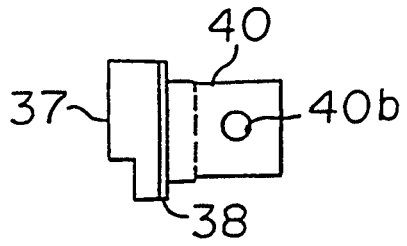
FIGS. 2A, 2B and 2C are respectively a front view, a bottom view and a side view of elements for supporting the shift lever shown in FIG. 1A.
Figure 2B:
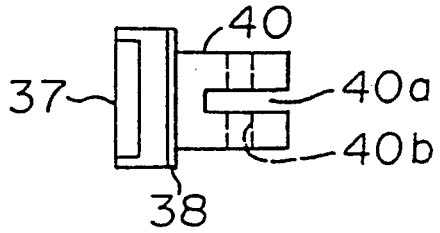
Figure 2C:
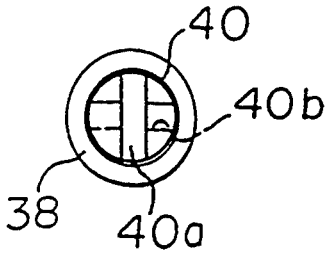

The structural elements for supporting the shift lever 34 shown in FIG. 1 are shown as a one-piece body for simplification of drawing in FIGS. 2A, 2B and 2C. The support 40 having the cut groove **40*a* at its front end portion corresponds to the conventional pair of support members 35 and the spacer 39. The shift lever 34 is inserted in the cut groove 40*a* of the support 40 and is supported by means of the connection pin 36. The support 40 as well as the shift lever 34 are inserted in and held by the retaining hole 6*a* of the front bracket 6. Accordingly, the shift lever 34** is supported in a freely turnable manner.

EXAMPLE 2

Figure 3A:
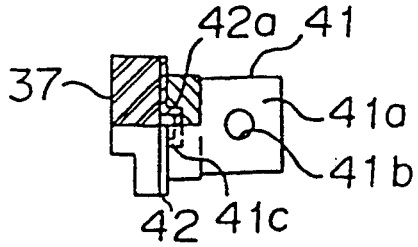
FIGS. 3A and 3B are respectively a front view and a bottom view which show the elements for supporting the shift lever according to a second embodiment of the present invention wherein the upper half portion of the elements are shown in cross-section.
Figure 3B:
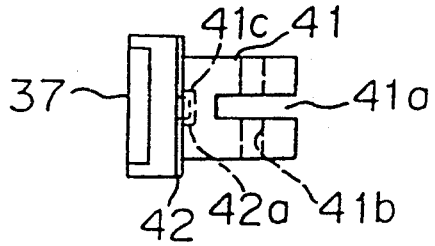

FIGS. 3A and 3B are respectively a front view and bottom view showing structural elements for supporting the shift lever 34 according to the second embodiment of the present invention in which the upper half portion of the elements is shown in cross-section.

A support 41, which is generally the same in material and shape as those of Example 1, has a cut groove **41*a* at its front end and an engaging hole 41*c* at the central portion of the rear end portion. A projection 42*a* is formed at the central portion of a contact plate 42 made of a metallic material. The projection 42*a* is fitted to an engaging hole 41*c* so that there is no danger of deviation in position in the radial direction of both members. Numeral 41*b*** designates a pin hole.

EXAMPLE 3

Figure 4:
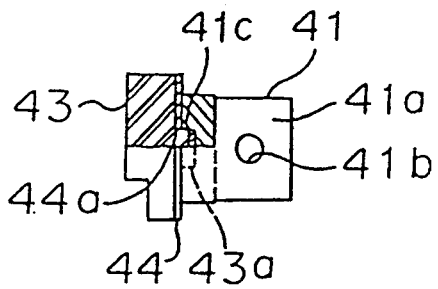
FIG. 4 is a front view of elements for supporting the shift lever according to a third embodiment of the present invention wherein upper half portion of the elements is shown in cross-section.

FIG. 4 is a front view of structural elements for supporting the shift lever according to the third embodiment of the present invention wherein the upper half portion of the elements is shown in cross section.

An engaging projection **43*a* is formed at the central portion of the front end surface of a packing 43. The engaging projection 43*a* is fitted to an engaging hole 41*c* formed in the support 41, whereby there occurs no deviation in position in the radial direction of both members. An opening 44***a* is formed at the central portion of a contacting plate 44 in which the engaging projection 43*a* is inserted.

EXAMPLE 4

Figure 5:
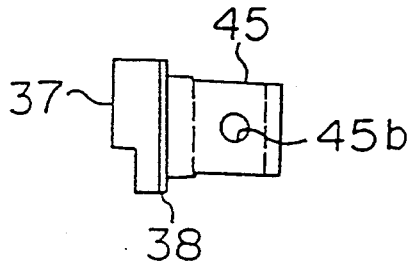
FIGS. 5A and 5B are respectively a front view and a bottom view of elements for supporting the shift lever according to a fourth embodiment of the present invention.
Figure 5:
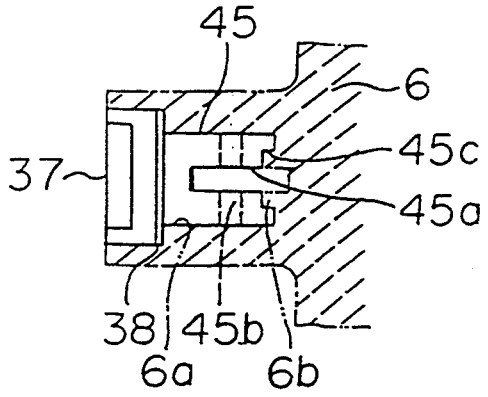
Figure 7:
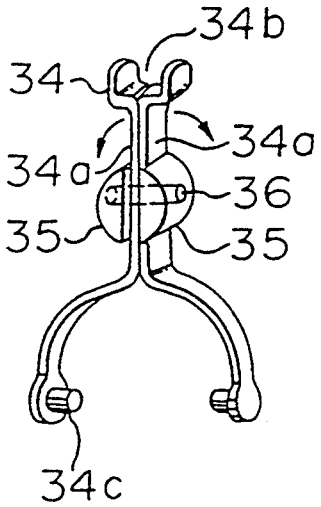
FIGURE 7 PRIOR ART
FIG. 7 is a perspective view of a conventional shift lever to which a supporter shown in FIG. 6A is connected.

FIGS. 5A and 5B are respectively a front view and a bottom view showing structural elements for supporting the shift lever according to the fourth embodiment of the present invention. A support 45 has notches 45*c* flanking a cut groove 45*a* in the front end portion of a support 45. Numeral 45*b* designates a pin hole. Projections 6*b* are formed at the bottom surface of a retaining hole 6*a* formed in the bracket 6 so as to be engaged with the notches 45*c*. When the support 45 is formed of a molded product of synthetic resin such as nylon, a deformation may be caused in projecting portions at both sides of the cut groove 45*a* due to a change of temperature or moisture absorption. However, in the fourth embodiment, since the front end of the support 45 is engaged with the projections 6*b* in the retaining hole 6*a* of the front bracket 6, the correct position can be maintained.

In the above-mentioned embodiments, the rear end of the packing is received by the front end of the intermediate bracket 4. However, when the intermediate bracket is not used, the rear end of the packing is received by the front end of the yoke.

As described above, in accordance with the present invention, a column-like support has a vertically extended cut groove at its front end portion; a shift lever is put in the cut groove so that the intermediate portion of the shift lever is received by both inner surface of the cut groove; a connection pin is inserted in the support and the shift lever to pivotally support the shift lever; a packing made of rubber is in contact with the rear end of the support by interposing a contacting plate; the support, the contacting plate and the packing are received in a retaining hole formed in a front bracket, and the rear end of the packing is received by the front end of an intermediate bracket or a yoke. Accordingly, the number of structural elements for supporting the shift lever can be reduced, and the shift lever can be smoothly and stably supported by the support in a freely turnable manner.

Obviously, numerous modifications and variations of the present invention are possible in light of the above teachings. It is therefore to be understood that within the scope of the appended claims, the invention may be practiced otherwise than as specifically described herein.

What is claimed is:

1. A shift lever supporting device for a starter motor which comprises:

a shift lever (34) having one end engaged with an axially movable hook (33) of an electromagnetic switch, another, opposite end having a stirrup shaped form to straddle an annular groove formed in an overrunning clutch so as to move said clutch in an axial direction, and a pivotally supported intermediate portion, the overrunning clutch being movable forwardly and rearwardly by the pivotal movement of the shift lever under the control of the switch;

a unitary cylindrical support (40; 41; 45) defining, at an axial inner end, a diametrical groove (40*a;* 41*a,* 45*a*) into which the intermediate portion of the shift lever is inserted;

a pivot pin (36) inserted through respective holes individually formed in the support and the intermediate portion of the shift lever to pivotally support the shift lever; and a packing (37) of resilient material having one end disposed proximate an outer end of the support through an interposed rigid disc (38; 42; 44), wherein the unitary cylindrical support, the disc and the packing are disposed in a cylindrical opening (6*a*) formed in a front motor bracket (6) having upper and lower slots into which upper and lower arms of the shift lever are inserted, the cylindrical opening facing, in an axial direction, another motor bracket (4) against which another, opposite end of the packing is supported.

* * * * *